US009908330B2

(12) United States Patent
Sugai

(10) Patent No.: US 9,908,330 B2
(45) Date of Patent: Mar. 6, 2018

(54) LIQUID DISCHARGE APPARATUS AND METHOD

(71) Applicant: SEIKO EPSON CORPORATION, Tokyo (JP)

(72) Inventor: Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/384,604

(22) Filed: Dec. 20, 2016

(65) Prior Publication Data

US 2017/0182769 A1 Jun. 29, 2017

(30) Foreign Application Priority Data

Dec. 28, 2015 (JP) ..... 2015-255786

(51) Int. Cl.

| | |
|---|---|
| ***B41J 2/07*** | (2006.01) |
| ***B41J 2/175*** | (2006.01) |
| ***B41J 2/03*** | (2006.01) |
| ***B41J 2/02*** | (2006.01) |
| ***B41J 2/105*** | (2006.01) |
| ***B41J 2/14*** | (2006.01) |

(52) U.S. Cl.

CPC . *B41J 2/07* (2013.01); *B41J 2/02* (2013.01); *B41J 2/03* (2013.01); *B41J 2/105* (2013.01); *B41J 2/1433* (2013.01); *B41J 2/175* (2013.01); *B41J 2002/033* (2013.01)

(58) Field of Classification Search

CPC ..... B41J 2/105; B41J 2002/033

See application file for complete search history.

(56) References Cited

U.S. PATENT DOCUMENTS

| | | | | |
|---|---|---|---|---|
| 3,878,519 | A * | 4/1975 | Eaton | B41J 2/02 239/13 |
| 7,185,973 | B2 * | 3/2007 | Gibson | B41J 2/02 347/73 |
| 7,374,273 | B2 | 5/2008 | Miura | |
| 2004/0226929 | A1 * | 11/2004 | Miura | B41M 3/006 219/121.85 |
| 2005/0196614 | A1 * | 9/2005 | Weber | B05D 1/02 428/411.1 |
| 2012/0225418 | A1 * | 9/2012 | Meyer | G01N 15/1459 435/2 |
| 2013/0342597 | A1 * | 12/2013 | Panchawagh | B41J 2/09 347/10 |

FOREIGN PATENT DOCUMENTS

| | | | | |
|---|---|---|---|---|
| JP | 58-116162 | | 7/1983 | |
| JP | 02143863 | A * | 6/1990 | B41J 2/09 |
| JP | 06-064161 | | 3/1994 | |
| JP | 2004-181448 | | 7/2004 | |
| JP | 2004298843 | A * | 10/2004 | |

* cited by examiner

*Primary Examiner* — Shelby Fidler
(74) *Attorney, Agent, or Firm* — Workman Nydegger

(57) ABSTRACT

A liquid discharge apparatus includes: a head unit that has nozzles that discharge a column-shaped liquid; a liquid droplet generating unit that applies cyclically changing energy to positions of the column-shaped liquids discharged from the nozzles, which are separated from the nozzles, and that generates liquid droplets; and a direction changing unit that changes a flying direction of at least some liquid droplets of the generated liquid droplets.

10 Claims, 4 Drawing Sheets

LIQUID DISCHARGE APPARATUS AND METHOD

BACKGROUND

1. Technical Field

The present invention relates to a liquid discharge apparatus and a liquid discharge method.

2. Related Art

In the related art, a liquid discharge apparatus that discharges a liquid and produces printed matter or a three-dimensional object is used. For example, in an ink jet printer disclosed in JP-A-6-64161, when a column-shaped liquid ink is ejected from a nozzle, a heat generating unit (laser) provided in a portion of the nozzle changes a viscosity of the ink, thereby generating pulsation in a liquid column, and forming ink particles.

However, in the technology disclosed in JP-A-6-64161, since the heat generating unit is provided in the portion of the nozzle from which ink is discharged, dried ink is likely to be attached and accumulated on an edge of the nozzle. The dried ink accumulated on the edge of the nozzle is likely to influence the ink discharge performance of the nozzle. Therefore, there has been a demand for technology in which it is possible to reduce accumulation of ink in the vicinity of a nozzle such that it is possible to stably discharge ink. The technology described above has objects that are common not only in an ink jet printer that discharges ink, but also in liquid discharge apparatuses that are capable of discharging various types of liquid.

SUMMARY

An advantage of some aspects of the invention is to solve at least a part of the problems described above, and the invention can be implemented as the following aspects.

(1) According to an aspect of the invention, a liquid discharge apparatus is provided. The liquid discharge apparatus includes: a head unit that has nozzles that discharge a column-shaped liquid; a liquid droplet generating unit that applies cyclically changing energy to positions of the column-shaped liquids discharged from the nozzles, which are separated from the nozzles, and that generates liquid droplets; and a direction changing unit that changes a flying direction of at least some liquid droplets of the generated liquid droplets. In this configuration, since the energy for generating liquid droplets is applied to the liquid at positions separated from the nozzles, it is possible to reduce an amount of liquid which dries and accumulates in the vicinity of the nozzles. Therefore, it is possible to stably discharge the liquid.

(2) In the liquid discharge apparatus according to the aspect described above, the liquid droplet generating unit may apply the energy to the column-shaped liquid through irradiation with a laser beam. In this configuration, it is possible to generate liquid droplets from the column-shaped liquid with high accuracy.

(3) In the liquid discharge apparatus according to the aspect described above, the direction changing unit may change the flying direction of at least some of the liquid droplets through irradiation with a laser beam. In this configuration, it is possible to change flying directions of liquids having various characteristics.

(4) In the liquid discharge apparatus according to the aspect described above, the liquid droplet generating unit may generate liquid droplets having a first size and liquid droplets having a second size that is larger than the first size.

In this configuration, it is possible to perform printing or forming a three-dimensional object using liquid droplets having a size suitable for an application.

(5) The liquid discharge apparatus according to the aspect described above may further include a collecting unit that collects the liquid droplets having the first size or the liquid droplets having the second size and that resupplies the collected liquid droplets to the head unit. In this configuration, since it is possible to collect and to reuse the liquid droplets, it is possible to efficiently use the liquid.

(6) In the liquid discharge apparatus according to the aspect described above, the direction changing unit may change a flying direction of the liquid droplets having the first size, but may not change a flying direction of the liquid droplets having the second size, and the collecting unit may collect the liquid droplets having the first size, of which the flying direction is changed, but may not collect the liquid droplets having the second size, of which the flying direction is not changed. In this configuration, since the flying direction of the liquid droplets having a small size (first size) is changed, it is possible to further change the flying direction of the liquid droplets, compared to a case of changing the flying direction of the liquid droplets having a large size (second size). Hence, it is possible to efficiently collect the liquid droplets having the small size.

(7) In the liquid discharge apparatus according to the aspect described above, the direction changing unit may change the flying direction of the liquid droplets having the first size, but may not change the flying direction of the liquid droplets having the second size, and the collecting unit may not collect the liquid droplets having the first size, of which the flying direction is changed, but may collect the liquid droplets having the second size, of which the flying direction is not changed. In this configuration, since it is possible to perform printing or forming a three-dimensional object using a liquid droplet having the small size (first size), it is possible to produce an image or the three-dimensional object in a fine manner.

(8) The liquid discharge apparatus according to the aspect described above may further include an energy applying unit that applies energy to the liquid droplets having landed on a predetermined target object. In this configuration, for example, it is possible to fix, to a target object, liquid droplets having landed.

(9) In the liquid discharge apparatus according to the aspect described above, the liquid may be a fluid composition that contains powder and a solvent, and the energy applying unit may apply energy to the liquid droplets having landed, thereby sintering the powder in the liquid or melting the powder in the liquid and then solidifying the powder. In this configuration, the powder in the liquid is sintered or solidified, thereby making it possible to fix, to a target object, the liquid droplets having landed.

The invention can be implemented as various aspects in addition to the aspect of the liquid discharge apparatus described above. For example, the invention can be implemented as an aspect of a method for discharging a liquid from a liquid discharge apparatus, a computer program for controlling a liquid discharge apparatus, a tangible non-transitory storing medium storing the computer program, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
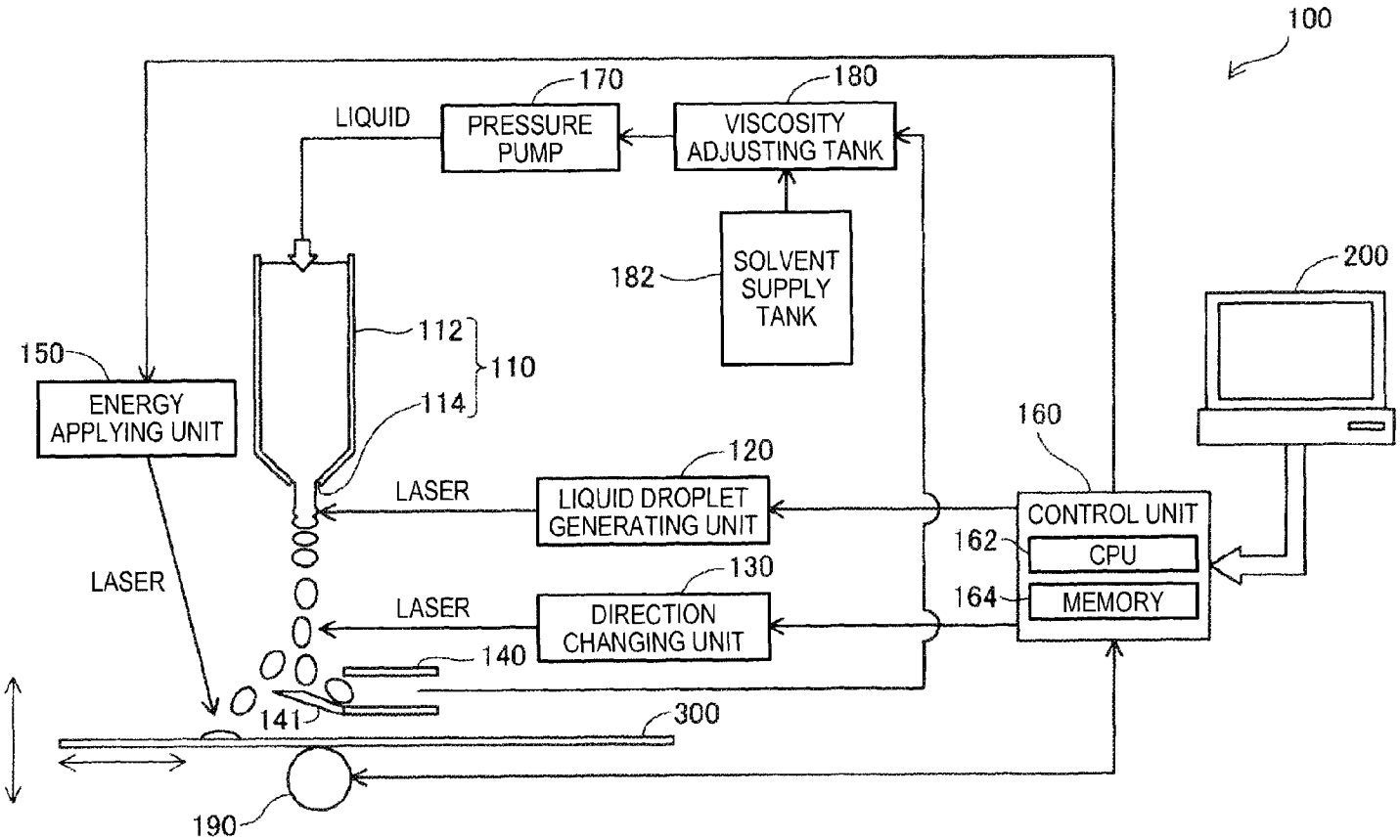
FIG. 1 is a diagram depicting a schematic configuration of a liquid discharge apparatus as a first embodiment.

FIG. 1 is a diagram depicting a schematic configuration of a liquid discharge apparatus 100 as the first embodiment of the invention. The liquid discharge apparatus 100 includes a head unit 110, a liquid droplet generating unit 120, and a direction changing unit 130. In addition, the discharge apparatus of the embodiment includes a collecting unit 140, an energy applying unit 150, a control unit 160, a pressure pump 170, a viscosity adjusting tank 180, a solvent supply tank 182, and a target object moving mechanism 190.

The head unit 110 has nozzles 114 that discharge a column-shaped liquid. More specifically, the head unit 110 has a syringe 112 as a liquid container that stores a liquid and nozzles 114 that communicate with the syringe 112 and discharge the liquid in the syringe 112 to the outside. In the embodiment, the syringe 112 has a cylindrical shape and is made of stainless steel. In addition, the nozzle 114 is formed as a through-hole provided in a portion of the syringe 112. The head unit 110 is not limited to such a configuration, but may employ various configurations as long as it is possible to discharge the stored liquid.

A liquid, to which the pressure pump 170 applies pressure, is supplied to the syringe 112. The column-shaped liquids are discharged from the nozzles 114 vertically downward due to the pressure. A liquid, of which a viscosity is adjusted, is supplied to the pressure pump 170 from the viscosity adjusting tank 180. A solvent is supplied from the solvent supply tank 182 to the viscosity adjusting tank 180 and the viscosity of the liquid is adjusted to a predetermined viscosity with the supplied solvent in the viscosity adjusting tank 180. The viscosity of the liquid in the embodiment is 50 mPa·s or higher. The pressure of the liquid in the nozzle 114 is monitored by using a manometer not illustrated, feedback control is performed on the pressure by the pressure pump 170, and thereby the pressure of the liquid in the nozzle 114 is maintained to be constant. In the embodiment, the pressure is adjusted such that the flow rate of the liquid that is discharged from the nozzle 114 is 10 m/sec to 20 m/sec.

In the embodiment, the liquid that is discharged from the nozzle 114 is a fluid composition that contains powder and a solvent. Examples of components of the liquid may include a slurry or paste of mixed materials that contains a solvent, a binder, and, for example, powder of a single element of magnesium (Mg), iron (Fe), cobalt (Co), chromium (Cr), aluminum (Al), titanium (Ti), copper (Cu), or nickel (Ni), or mixed powder such as an alloy containing one or more types of metal described above (maraging steel, stainless steel, cobalt-chromium-molybdenum, a titanium alloy, a nickel alloy, an aluminum alloy, a cobalt alloy, or a cobalt-chromium alloy). In addition, other examples of components may include general-purpose engineering plastics, such as a polyamide, polyacetal, polycarbonate, modified polyphenylene ether, polybutylene terephthalate, or polyethylene terephthalate or the like. In addition, still other examples of components may also include engineering plastics such as a polysulfone, polyethersulfone, polyphenylene sulfide, polyarylate, polyimide, polyamide-imide, polyetherimide, or polyether ether ketone. As described above, there is no particular limitation on the components and it is possible to use metal other than the metal described above, ceramics, resins or the like. In addition, examples of the solvent may include, for example, water; (poly)alkylene glycol monoalkyl ethers such as ethylene glycol monomethyl ether, ethylene glycol monoethyl ether, propylene glycol monomethyl ether, or propylene glycol monoethyl ether; acetate esters such as ethyl acetate, n-propyl acetate, isopropyl acetate, n-butyl acetate, or isobutyl acetate; aromatic hydrocarbons such as benzene, toluene, or xylene; ketones such as methyl ethyl ketone, acetone, methyl isobutyl ketone, ethyl-n-butyl ketone, diisopropyl ketone, or acetylacetone; alcohols such as ethanol, propanol, or butanol; tetraalkylammonium acetates; a sulfoxide-based solvent medium such as dimethyl sulfoxide or diethyl sulfoxide; a pyridine-based solvent medium such as pyridine, gamma-picoline, or 2,6-lutidine; an ionic liquid such as tetraalkylammonium acetate (for example, tetrabutylammonium acetate), or a combination of one or more types selected from the substances described above. In addition, examples of the binder may include, for example, acrylic resins, epoxy resins, silicone resins, cellulose-based resins, synthetic resins other than the resins described above, polylactic acid (PLA), a polyamide (PA), polyphenylene sulfide (PPS), or thermoplastic resins other than the substances described above.

The liquid droplet generating unit 120 applies cyclically changing energy to positions of the column-shaped liquids discharged from the nozzles 114, which are separated from the nozzles 114, and that generates liquid droplets. The liquid droplet generating unit 120 is disposed at a position separated from the nozzles 114. The liquid droplet generating unit 120 of the embodiment is a laser device that performs irradiation with light energy (a laser beam) and includes a laser beam source and a condenser for condensing, on the column-shaped liquid, a laser beam emitted from the laser beam source. The column-shaped liquid is irradiated with the laser beam emitted from the liquid droplet generating unit 120 at the position separated from the nozzle 114. In the embodiment, the position at which the column-shaped liquid is irradiated with the laser beam is the position which is separated from the nozzle 114 by 0.5 mm vertically downward. In the embodiment, the column-shaped liquid is irradiated with the laser beam in a direction (vertical direction) in which the liquid flows and in a perpendicular direction (horizontal direction). The liquid droplet generating unit 120 of the embodiment irradiates the column-shaped liquid with a pulsed laser beam having cyclically changing energy. When the liquid is irradiated with such a laser beam, a portion having a high temperature and a portion having a low temperature are formed in a direction in which the column-shaped liquid flows, and thereby the liquid column is cut and liquid droplets are generated from the liquid column. The generated liquid droplets fly vertically downward. A timing or energy of the laser beam irradiation by the liquid droplet generating unit 120 is determined in advance depending on the characteristics of the liquids, and is controlled by the control unit 160. Note that, in terms of irradiation efficiency of the laser beam, it is preferable that a diameter of a spot of the laser beam, with which the column-shaped liquid is irradiated, is smaller than or equal to a diameter of the liquid column. However, the diameter of the spot of the laser beam may be larger than the diameter of the liquid column.

The direction changing unit 130 changes a flying direction of at least some liquid droplets of the liquid droplets generated by the liquid droplet generating unit 120. The direction changing unit 130 of the embodiment is a laser device and includes a laser beam source and a condenser for condensing, on the liquid droplets, a laser beam emitted from the laser beam source. The direction changing unit 130 irradiates the liquid droplets flying vertically downward with the laser beams in a direction perpendicular to the flying direction and changes the flying direction of the flying liquid droplets. The position at which the flying liquid droplets are irradiated with the laser beams is the position which is separated from the head unit 110 by 1 mm vertically downward. When the flying liquid droplets are irradiated with the laser beams, at least a part of a solvent in the liquid droplets is instantaneously gasified, then gas is produced, and the flying direction of the liquid droplets is changed due to pressure of the gas. The higher the energy of the irradiation with the laser beam and the smaller the size of the liquid droplets, the more a degree of a change in the flying direction of the liquid droplets is increased. The irradiation with the laser beam by the direction changing unit 130 is performed at a timing at which the liquid droplets cross the direction changing unit 130. A timing or energy of the laser beam irradiation by the direction changing unit 130 is determined in advance depending on the characteristics of the liquids, and is controlled by the control unit 160. In the embodiment, the liquid droplets having the flying direction changed by the direction changing unit 130 land on a target object 300 that is disposed vertically below the head unit 110 by 2 mm. For example, the target object 300 is a recording medium or a forming stage.

The collecting unit 140 collects at least some liquid droplets generated by the liquid droplet generating unit 120 and resupplies the collected liquid to the head unit 110. The collecting unit 140 has a receptacle 141 for collecting liquid droplets flying in from above. The liquid droplets collected in the receptacle 141 are sent to the viscosity adjusting tank 180 by a suction device not illustrated, the viscosity of the liquid is adjusted, and then the liquid is resupplied to the head unit 110. In the embodiment, the collecting unit 140 collects the liquid droplets of which the flying direction is not changed by the direction changing unit 130. The collecting unit 140 is also called a "gutter".

The energy applying unit 150 applies energy to the liquid droplets that have landed on the target object 300 such that the liquid droplets harden. In the embodiment, the energy applying unit 150 is a laser device that applies light energy (a laser beam) to the liquid droplets. The energy applying unit 150 includes a laser beam source and a condenser for condensing, on the liquid droplets having landed, a laser beam emitted from the laser beam source. The energy applying unit 150 applies energy to the liquid droplets having landed, thereby sintering powder in the liquid droplets or melting the powder and then solidifying the powder. In the embodiment, in this manner, the particles in the liquid droplets are fixed on the target object 300.

The target object moving mechanism 190 is a mechanism that causes the target object 300 to move with respect to the head unit 110 in the horizontal direction or in the vertical direction. In the embodiment, the positions of the head unit 110 and the energy applying unit 150 are fixed and the target object 300 is caused to move by the target object moving mechanism 190. The target object moving mechanism 190 includes various types of actuators such as a motor for moving the target object 300. Note that, in the embodiment, the position of the target object 300 may be fixed and the head unit 110 may move along with the energy applying unit 150. The movement of the target object 300 by the target object moving mechanism 190 is controlled by the control unit 160.

The control unit 160 controls the entirety of the liquid discharge apparatus 100. The control unit 160 includes a CPU 162 and a memory 164. The CPU 162 executes a program stored in the memory 164, thereby controlling the liquid discharge apparatus 100. The program may be recorded in various types of recording medium.

A computer 200 is connected to the control unit 160. The control unit 160 receives, from the computer 200, data indicating a position on the target object 300 to which the liquid droplets are discharged. The control unit 160 controls, in response to the data received from the computer 200, the pressure pump 170, the liquid droplet generating unit 120, the direction changing unit 130, the target object moving mechanism 190, and the energy applying unit 150, causes the liquid droplets to land on the target object 300, and performs printing or forming a three-dimensional object on the target object 300. Note that the control unit 160 may directly acquire the data via a network, a recording medium, or the like, not from the computer 200.

Figure 2:
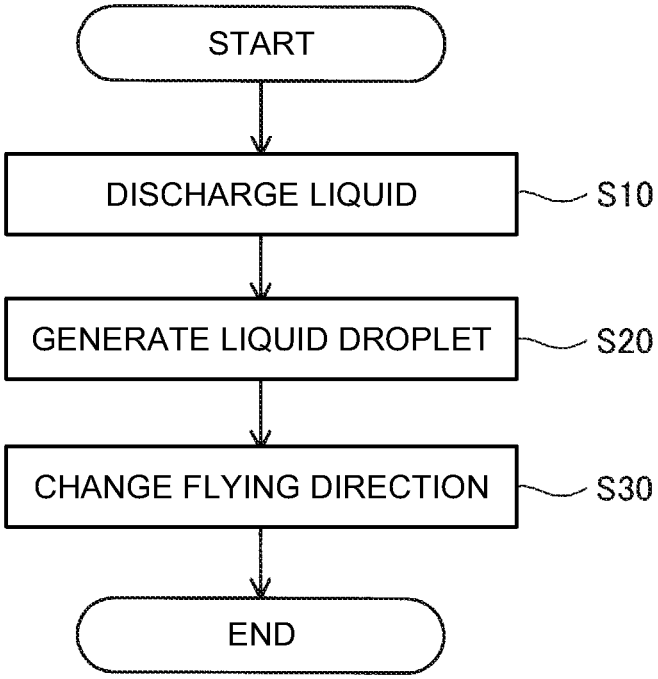
FIG. 2 is a flowchart of a control process.

FIG. 2 is a flowchart illustrating a control process which is repeatedly performed by the control unit 160 according to the program. First, the control unit 160 controls the pressure pump 170 such that the column-shaped liquids are discharged from the nozzles 114 included in the head unit 110 (Step S10). The control unit 160 controls the liquid droplet generating unit 120 such that the liquid droplet generating unit applies the cyclically changing energy to the positions of the column-shaped liquids, which are separated from the nozzles 114, and generates liquid droplets (Step S20). In the embodiment, the liquid droplet generating unit 120 irradiates the column-shaped liquids with a laser beam having a predetermined constant cycle. Then, liquid droplets having a constant size are generated one after another from the column-shaped liquid discharged from the nozzle 114. When the liquid droplets are generated, the control unit 160 controls the direction changing unit 130 such that the direction changing unit changes the flying direction of at least some liquid droplets of the generated liquid droplets (Step S30). In Step S30, the control unit 160 controls, in response to the data received from the computer 200, the target object moving mechanism 190 such that the target object moving mechanism causes the target object 300 to move, and for the liquid droplets that are caused to land on the target object 300, the control unit 160 controls the direction changing unit 130 such that the direction changing unit irradiates the liquid droplets with the laser beam and changes the flying direction of the liquid droplets. By comparison, for the liquid droplets that are caused not to land on the target object 300, irradiation with the laser beam from the direction changing unit 130 is not performed and the liquid droplets are collected in the collecting unit 140. Through such control, the control unit 160 can cause the liquid droplets to land on any position on the target object 300 such that it is possible to perform printing and forming a three-dimensional object.

In the liquid discharge apparatus 100 of the embodiment described above, since the energy for generating liquid droplets is applied to the liquid at the positions separated from the nozzles 114, it is possible to reduce an amount of liquid which dries and accumulates in the vicinity of the nozzles 114. Therefore, it is possible to stably discharge the liquid.

In addition, in the embodiment, since the laser beam is used as the energy for generating the liquid droplets, it is possible to generate liquid droplets from the column-shaped liquid with high accuracy. In addition, since the liquid droplets are generated by using the laser beam, for example, it is possible to generate liquid droplets from a liquid having much higher viscosity than that of a piezo-type or thermal-type liquid discharge apparatus.

In addition, in the embodiment, since the flying direction of the liquid is changed by using the laser beam, it is possible to perform the printing and the forming of the three-dimensional object by using liquids having various characteristics. For example, in technology in which the liquid droplets are charged and the flying direction is changed due to an electrostatic force, there is a need to use a liquid that can be charged. In the embodiment, since it is possible to use a liquid material that cannot be charged, it is possible to perform the printing or the forming of the three-dimensional object using various materials.

In addition, in the embodiment, since some of the liquid droplets are collected in the collecting unit 140 and are reused, it is possible to efficiently use the liquid.

In addition, in the embodiment, since the liquid droplets are generated from the liquid through the applying of energy from the outside of the head unit 110, it is possible to simplify the structure of the head unit 110 and it is possible for the head unit 110 to have high pressure resistance. Therefore, it is possible to perform the printing or the forming of the three-dimensional object using liquids having various degrees of the viscosity.

B. Second Embodiment

Figure 3:
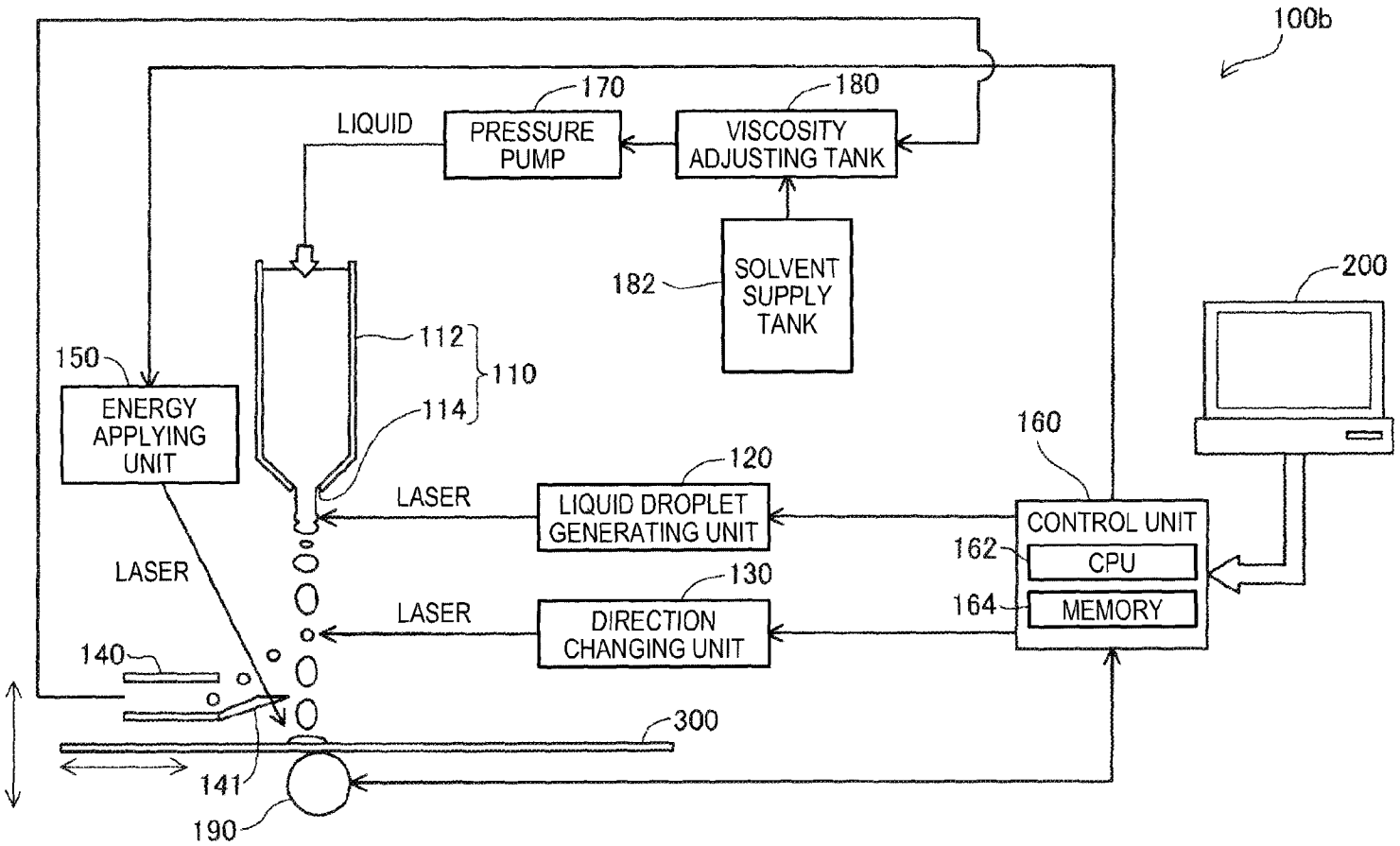
FIG. 3 is a diagram depicting a schematic configuration of a liquid discharge apparatus as a second embodiment.

FIG. 3 is a diagram depicting a schematic configuration of a liquid discharge apparatus 100*b* as the second embodiment of the invention. The liquid discharge apparatus 100*b* of the embodiment has the same configuration as the liquid discharge apparatus 100 of the first embodiment. The embodiment differs from the first embodiment in that the liquid droplet generating unit 120 generates liquid droplets having two sizes. In the specification, a size of a liquid droplet means a volume of a liquid droplet. Note that the size of the liquid droplet may be construed as a weight of the liquid droplet.

The liquid droplet generating unit 120 of the embodiment generates, from the column-shaped liquid, liquid droplets having a first size and liquid droplets having a second size that is larger than the first size. The control unit 160 controls the liquid droplet generating unit 120 such that the liquid droplets having the first size and the liquid droplets having the second size are generated at different irradiation intervals of the laser beams with which the liquid columns are irradiated and thereby the liquid droplets are generated to have different sizes. For example, when the irradiation with the laser beams is performed at short intervals, it is possible to generate liquid droplets having a small size to the extent of the short intervals. Conversely, when the irradiation with the laser beams is performed at long intervals, it is possible to generate liquid droplets having a large size to the extent of the long intervals. Note that the control unit 160 may control time of irradiation, an output of irradiation, or a range of irradiation with the laser beam, thereby generating liquid droplets having different sizes from each other.

In the embodiment, the control unit 160 controls the liquid droplet generating unit 120 such that the liquid droplets that do not land on the target object 300 are generated to have the first size and the liquid droplets that land on the target object 300 are generated to have the second size. The control unit 160 controls the direction changing unit 130 such that the direction changing unit does not irradiate, with the laser beam, the liquid droplets having the second size which are caused to land on the target object 300, but selectively irradiates, with the laser beam, the liquid droplets having the first size which are caused not to land on the target object 300, so as to change the flying direction. The collecting unit 140 collects the liquid droplets having the first size, of which the flying direction is changed, but does not collect the liquid droplets having the second size, of which the flying direction is not changed.

In the liquid discharge apparatus 100*b* of the embodiment described above, since the liquid droplet generating unit 120 changes the energy so as to generate the liquid droplets having the first size and the liquid droplets having the second size larger than the first size, it is possible to perform the printing and the forming of the three-dimensional object using liquid droplets having a size suitable for an application. Particularly in the embodiment, since the flying direction of the liquid droplets having the small size (first size) is changed with the laser beam, it is possible to more increase the change in the flying direction, compared to a case of changing the flying direction of the liquid droplets having the large size (second size). Therefore, it is possible to efficiently collect unnecessary liquid droplets, and it is possible to reduce liquid droplets that do not need to land, but land on the target object 300 by accident.

C. Third Embodiment

Figure 4:
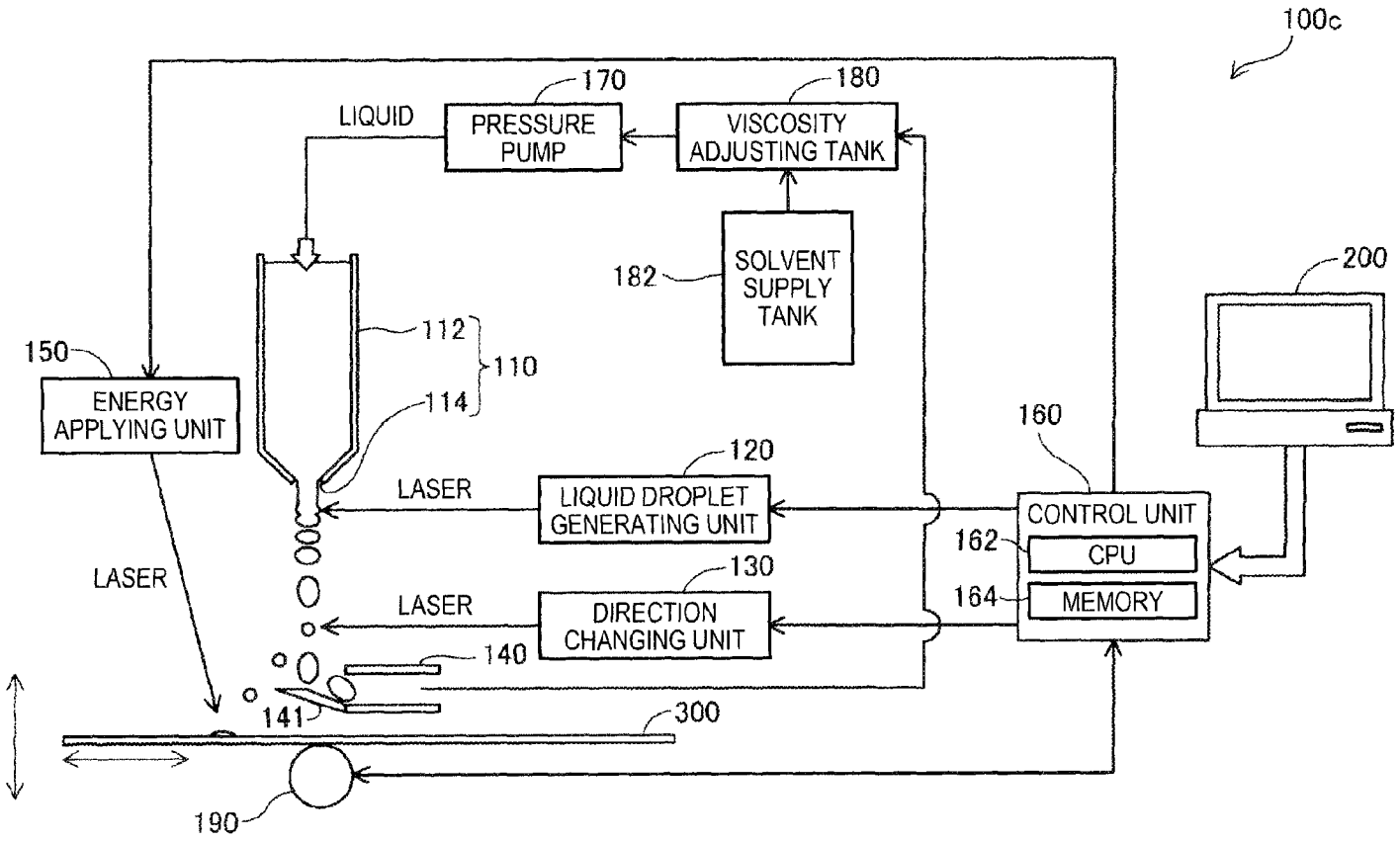
FIG. 4 is a diagram depicting a schematic configuration of a liquid discharge apparatus as a third embodiment.

FIG. 4 is a diagram depicting a schematic configuration of a liquid discharge apparatus 100*c* as the third embodiment of the invention. The liquid discharge apparatus 100*c* of the embodiment has the same configuration as the liquid discharge apparatus 100 of the first embodiment. In the second embodiment, the liquid droplets having the small size are collected. However, in the third embodiment, the liquid droplets having the large size are collected.

Similar to the second embodiment, the liquid droplet generating unit 120 of the embodiment generates, from the column-shaped liquid, liquid droplets having the first size and liquid droplets having the second size that is larger than the first size. In contrast to the second embodiment, the control unit 160 of the embodiment performs control such that the liquid droplets that do not land on the target object 300 are generated to have the second size and the liquid droplets that land on the target object 300 are generated to have the first size. The control unit 160 controls the direction changing unit 130 such that the direction changing unit does not irradiate, with the laser beam, the liquid droplets having the second size which are caused not to land on the target object 300, but selectively irradiates, with the laser beam, the liquid droplets having the first size which are caused to land on the target object 300, so as to change the flying direction. The collecting unit 140 does not collect the liquid droplets having the first size, of which the flying direction is changed, but collects the liquid droplets having the second size, of which the flying direction is not changed.

In the liquid discharge apparatus 100*c* of the embodiment described above, similar to the second embodiment, it is possible to perform the printing and the forming of the three-dimensional object using liquid droplets having a size suitable for an application. Particularly in the embodiment, the flying direction of the liquid droplets having the small size (first size) is changed with the laser beam and the liquid droplets are caused to land on the target object 300. Hence, since it is possible to perform the printing or the forming of the three-dimensional object using the liquid droplet having the small size, it is possible to produce an image or the three-dimensional object in a fine manner. In addition, in the embodiment, since the liquid droplets having the large size are collected, a collection rate of the liquid is increased and it is possible to efficiently use the liquid. In addition, in the embodiment, since the flying direction of the liquid droplets having the small size is changed, it is possible to more increase the change in the flying direction, compared to a case of changing the flying direction of the liquid droplets having the large size. Therefore, the droplets that need to land are less likely to be collected in the collecting unit 140 by accident.

D. Fourth Embodiment

A liquid discharge apparatus of the fourth embodiment has the same configuration as the liquid discharge apparatus 100*c* of the third embodiment illustrated in FIG. 4. In the third embodiment described above, the control unit 160 controls the direction changing unit 130 such that the direction changing unit selectively irradiates, with the laser beam, the liquid droplets having the first size which are caused to land on the target object 300, so as to change the flying direction. By comparison, in the fourth embodiment, the control unit 160 controls the direction changing unit 130 such that the direction changing unit irradiates, with the laser beam, all of the liquid droplets that fly to land, regardless of the size of the liquid droplets. Even when all of the liquid droplets that fly to land are irradiated with the laser beam, it is possible to collect the liquid droplets having the large size and it is possible to cause the liquid droplets having the small size to land on the target object 300 because the flying direction of the liquid droplets having the small size is more changed than the flying direction of the liquid droplets having the large size. According to the embodiment, since the flying direction of the liquid droplets having the large size is changed, the receptacle 141 of the collecting unit 140 is disposed at a position at which it is possible to collect the liquid droplets having the large size, of which the flying direction is changed. Note that, in the embodiment, the direction changing unit 130 may perform the irradiation with the laser beam all the time, or may perform the irradiation to all of the liquid droplets with the pulsed laser beam.

E. Modification Example

First Modification Example

In the embodiment described above, the laser beam is used to perform generation of liquid droplets from the liquid and the change in the flying direction of the liquid droplets. By comparison, energy other than the laser beam may be used to perform at least one of the generation of liquid droplets from the liquid and the change in the flying direction of the liquid droplets. For example, it is possible to use a maser beam as energy other than the laser beam.

Second Modification Example

In the embodiments described above, the condensed positions of the laser beams with which the direction changing unit 130 performs irradiation may not be adjusted with accuracy as long as the flying direction of the liquid droplets can be changed. For example, without focusing the laser beam as a spot on the liquid droplets, the irradiation may be performed with a plane-shaped laser beam along a plane perpendicular to the flying direction of the liquid droplets and the flying direction of the liquid droplets may be changed. In addition, the irradiation may be performed with the laser beam of which a condensed spot has an elliptical shape and the flying direction of the liquid droplets may be changed.

Third Modification Example

In the second embodiment described above, the liquid discharge apparatus 100*b* may include an actuator that causes the collecting unit 140 to move vertically below the nozzles until the direction changing unit 130 starts driving. When the collecting unit 140 is positioned vertically below the nozzles until the direction changing unit 130 starts driving, it is possible to reduce an amount of unnecessary liquid droplets landing on the target object 300.

Fourth Modification Example

According to the embodiments described above, the liquid discharge apparatus 100 may have a configuration in which the collecting unit 140 is omitted such that, for example, the unnecessary liquid droplets are discarded. In addition, as long as it is possible to supply a high-pressure liquid to the syringe 112, the pressure pump 170, the viscosity adjusting tank 180, and the solvent supply tank 182 may have any configurations.

Fifth Modification Example

In the second embodiment and the third embodiment, the liquid droplet generating unit 120 generates liquid droplets having two sizes. By comparison, the liquid droplet generating unit 120 may generate liquid droplets having more sizes.

Sixth Modification Example

In the liquid discharge apparatus 100 of the embodiment described above, the energy applying unit 150 sinters or solidifies the liquid droplets whenever the liquid droplets land. By comparison, the energy applying unit 150 may apply energy, sinter, or solidify the liquid droplets after the printing or the forming of the three-dimensional object using the liquid droplets is completed. In addition, the energy applied by the energy applying unit 150 is not limited to the laser beam, and, for example, a heater may apply thermal energy, or may apply light energy such as ultraviolet light, or electromagnetic energy such as a microwave, depending on the characteristics of the liquid.

Seventh Modification Example

In the embodiments described above, the direction changing unit 130 changes the flying direction of the liquid droplets through the irradiation with the laser beam to the liquid droplets. By comparison, the direction changing unit 130 may apply a current of air to the liquid droplets in the horizontal direction, thereby changing the flying direction of the liquid droplets. For example, it is preferable that such a technique may be applied to an example in which the flying direction of all of the liquid droplets is changed, as in the fourth embodiment.

Eighth Modification Example

According to the embodiments described above, some or all of functions and processes executed by software may be executed by hardware. In addition, some or all of functions and processes executed by hardware may be executed by software. It is possible to use, as hardware, various types of circuits such as an integrated circuit, a discrete circuit, or a circuit module in which the circuits are combined.

The invention is not limited to the embodiments or modification examples described above, and it is possible to implement the invention with various configurations within a range without departing from a gist thereof. For example, it is possible to appropriately replace or combine technical features of the embodiments or the modification examples, which correspond to technical features in the aspects described in Summary, in order to achieve some or all of the objects described above or in order to achieve some or all of the effects described above. In addition, if the technical features are not described as essential in the specification, it is possible to appropriately remove the technical features.

The entire disclosure of Japanese patent No. 2015-255786, filed Dec. 28, 2015 is expressly incorporated by reference herein.

What is claimed is:

1. A liquid discharge apparatus comprising:

a head unit that has nozzles that discharge a column-shaped liquid, wherein the column-shaped liquid includes a solvent;

a liquid droplet generating unit that applies cyclically changing energy to positions of the column-shaped liquids discharged from the nozzles, which are separated from the nozzles, and that generates liquid droplets; and a direction changing unit that changes a flying direction of at least some liquid droplets of the generated liquid droplets by gasifying a portion of the solvent included in the at least some of the liquid droplets.

2. The liquid discharge apparatus according to claim 1, wherein the liquid droplet generating unit applies the energy to the column-shaped liquid through irradiation with a laser beam.

3. The liquid discharge apparatus according to claim 1, wherein the direction changing unit changes the flying direction of at least some of the liquid droplets through irradiation with a laser beam.

4. The liquid discharge apparatus according to claim 1, wherein the liquid droplet generating unit generates liquid droplets having a first size and liquid droplets having a second size that is larger than the first size.

5. The liquid discharge apparatus according to claim 4, further comprising:

a collecting unit that collects the liquid droplets having the first size or the liquid droplets having the second size and that resupplies the collected liquid to the head unit.

6. The liquid discharge apparatus according to claim 5, wherein the direction changing unit changes the flying direction of the liquid droplets having the first size, but does not change the flying direction of the liquid droplets having the second size, and wherein the collecting unit collects the liquid droplets having the first size, of which the flying direction is changed, but does not collect the liquid droplets having the second size, of which the flying direction is not changed.

7. The liquid discharge apparatus according to claim 5, wherein the direction changing unit changes the flying direction of the liquid droplets having the first size, but does not change the flying direction of the liquid droplets having the second size, and wherein the collecting unit does not collect the liquid droplets having the first size, of which the flying direction is changed, but collects the liquid droplets having the second size, of which the flying direction is not changed.

8. The liquid discharge apparatus according to claim 1, further comprising:

an energy applying unit that applies energy to the liquid droplets having landed on a predetermined target object.

9. The liquid discharge apparatus according to claim 8, wherein the liquid is a fluid composition that contains powder and a solvent, and wherein the energy applying unit applies energy to the liquid droplets having landed, thereby sintering the powder in the liquid droplets or melting the powder in the liquid droplets and then solidifying the powder.

10. A method for discharging a liquid from a liquid discharge apparatus, the method comprising:

discharging column-shaped liquids from nozzles provided in a head unit of the liquid discharge apparatus, wherein the column-shaped liquids include a solvent;

applying cyclically changing energy to positions of the column-shaped liquids discharged from the nozzles, which are separated from the nozzles, and generating liquid droplets; and gasifying a portion of the solvent, wherein a change in a pressure of the resulting gas changes a flying direction of at least some liquid droplets of the generated liquid droplets.

* * * * *